United States Patent [19]

Martincic

[11] Patent Number: 4,936,124

[45] Date of Patent: Jun. 26, 1990

[54] ROLL FORGING MACHINE AND METHOD

[75] Inventor: Mike B. Martincic, Mentor, Ohio

[73] Assignee: The Ajax Manufacturing Co., Cleveland, Ohio

[21] Appl. No.: 382,912

[22] Filed: Jul. 21, 1989

Related U.S. Application Data

[62] Division of Ser. No. 251,517, Sep. 30, 1988, Pat. No. 4,893,492.

[51] Int. Cl.[5] ..... B21B 39/06

[52] U.S. Cl. ..... 72/13; 72/222; 72/364

[58] Field of Search ..... 209/599; 219/7.5; 72/13, 202, 222, 252, 422, 364; 198/464.4

[56] References Cited

U.S. PATENT DOCUMENTS

| | | | |
|---|---|---|---|
| 2,790,530 | 4/1957 | Stoltz | 72/422 |
| 3,338,081 | 8/1967 | Schiller | 72/252 |
| 3,630,061 | 12/1971 | Wilson | 72/252 |
| 3,831,425 | 8/1974 | Kita | 219/7.5 |
| 4,449,390 | 5/1984 | Pontini | 72/422 |

*Primary Examiner*—Lowell A. Larson

*Attorney, Agent, or Firm*—Renner, Otto, Boisselle & Sklar

[57] ABSTRACT

A roll forging machine includes an automatic stock feed which receives the stock in a receptacle from a conveyor and then swings the stock to a horizontal feed position after sensing the temperature of the stock. If the stock temperature is insufficient for proper forging the receptacle swings to a dump position to return the stock to a furnace. If the stock temperature is sufficient the receptacle in the horizontal position is indexed into the forging rolls and to place the stock into a stock gripper of a transfer. The stock gripper is mounted on a grip slide for movement in the "X" direction aligned with the direction of the roll passes. The grip slide is in turn mounted on a carriage for movement in the "Y" direction transverse the direction of the roll passes. Both the grip slide and the carriage are driven electrically by respective servomotors in turn driving timing belts to which the carriage and grip slide are clamped. The servomotor for the grip slide accelerates the stock to a predetermined velocity until the stock is engaged by the forging rolls and then enters a free-wheeling mode during roll forging during which the grip slide is driven by the forging rolls, and then decelerates the stock. During the free-wheeling mode the servomotor for the grip slide may exert a slight tension or compression bias on the stock. The carriage moves the grip slide from pass to pass and may do so in any order. During the movement from pass to pass the gripper and thus the stock is rotated 90°. At the completion of the roll forging the grip slide accelerates the stock to an exit velocity whereupon the stock is released by the gripper to exit the machine. The grip slide returns the open gripper to receive the next stock to repeat the roll forging cycle.

19 Claims, 11 Drawing Sheets

FIG. 11
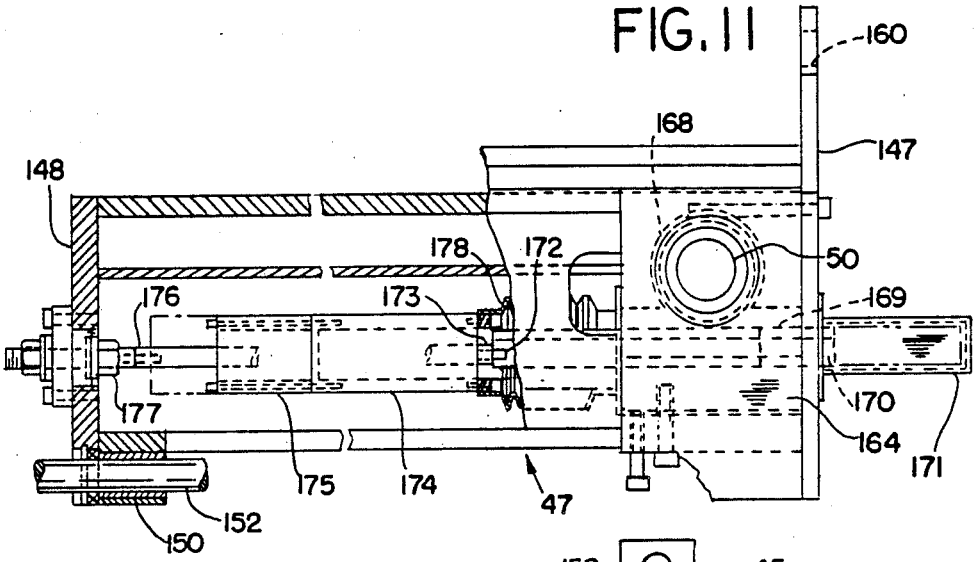
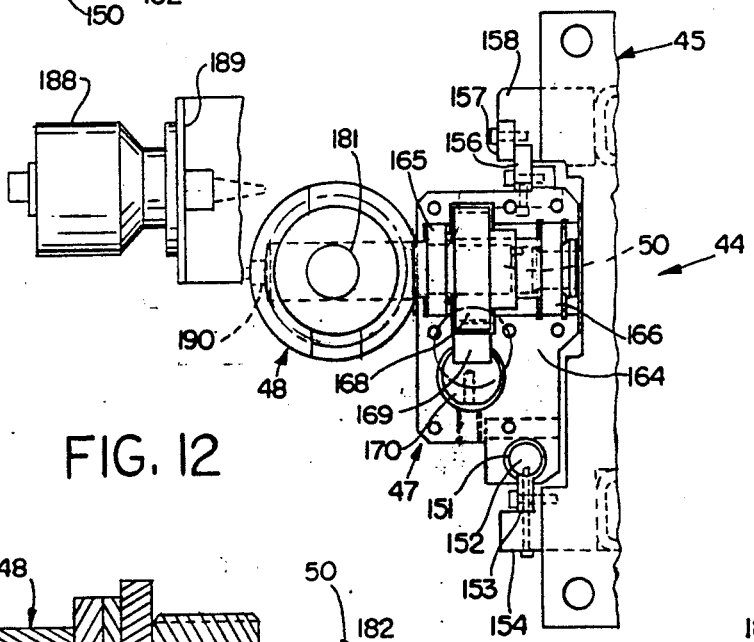
FIG. 12
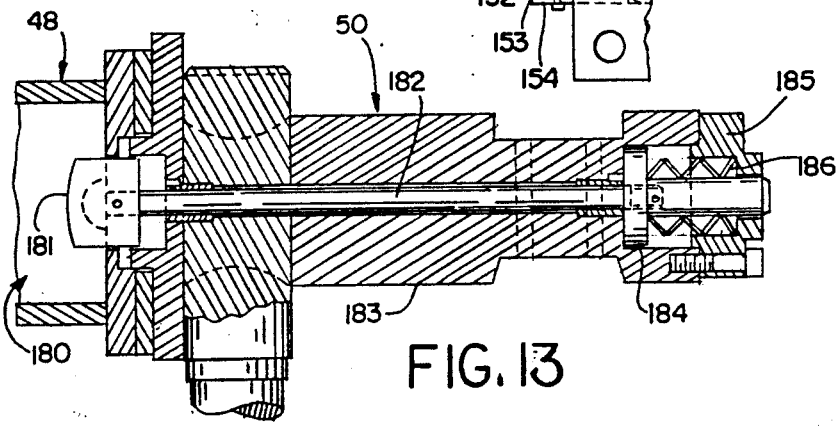
FIG. 13

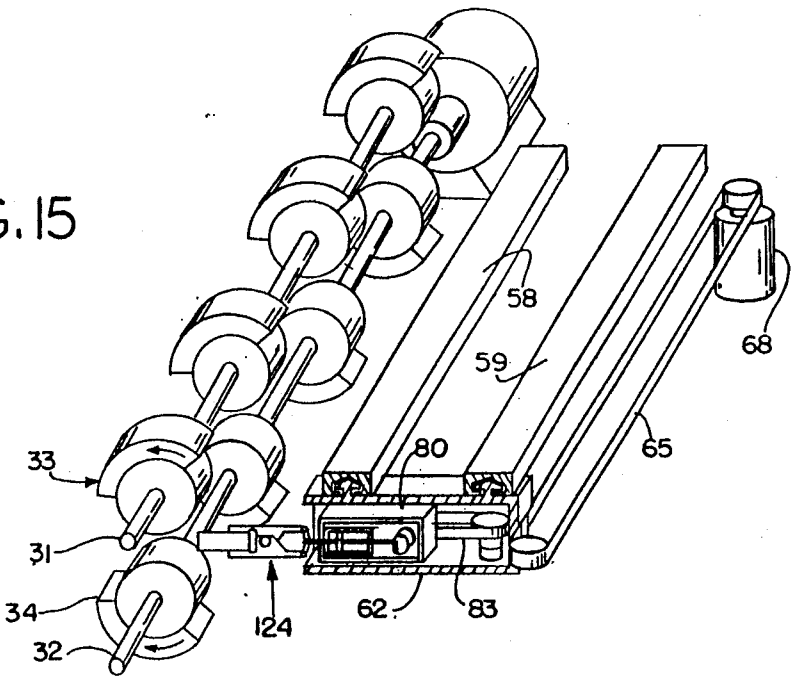
FIG. 14
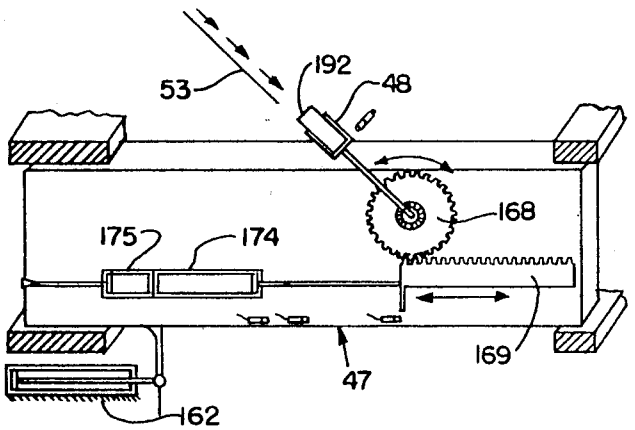
FIG. 15
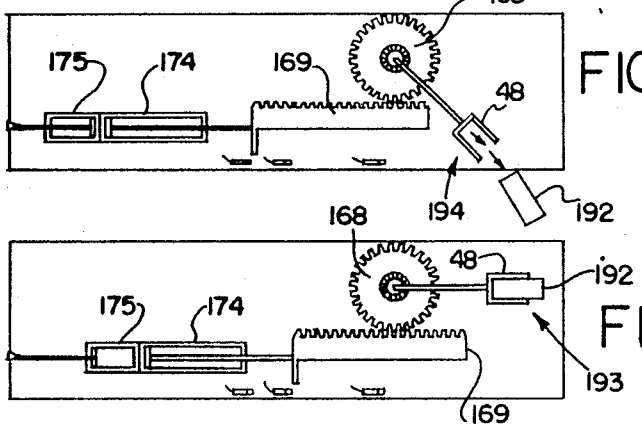
FIG. 16
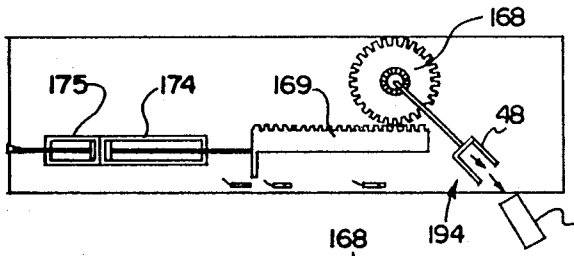

ROLL FORGING MACHINE AND METHOD

This application is a division of Ser. No. 251,517 filed Sept. 30, 1988, now Pat. No. 4,893,492 granted Jan. 16, 1990.

DISCLOSURE

This invention relates generally as indicated to a roll forging machine and method, and more particularly to a roll forging machine which includes an automatic feed and transfer.

BACKGROUND OF THE INVENTION

Roll forging machines have upper and lower rolls forming a set. The rolls include dies which rotate at the same speed but in opposite directions. The dies on the rolls form side-by-side rolling passes. Heated stock is moved sequentially through the passes and the rotating dies move the stock between the rolls forging the metal in a desired shape and length. Roll forging machines vary substantially in size and stock is fed through the various roll passes by tongs or grippers which may be manually or automatically manipulated. Examples of roll forging machines are those manufactured by Ajax Manufacturing Company of Cleveland, Ohio and as seen in U.S. Pat. No. 3,033,063.

The manipulation of stock through the various roll passes must be done with some precision and swiftly to achieve both forging accuracy and efficient production rates. For example, each pass requires a start and gauging or pick-up position which may vary from pass to pass. Also, since the stock is growing in length from pass to pass and must normally be rotated 90° about its axis between each pass, the manual manipulation of the stock requires great skill and strength, particularly for heavy stock.

Efforts have been made to mechanize the feed or manipulation of the stock in roll forging machines and reference may be had to the mechanical system shown in Schiller U.S. Pat. No. 3,338,081. While mechanical drive feed mechanisms may be acceptable with certain simplified stock and rolling operations, they are unable to provide the sophistication necessary for special shapes or more complex roll forging operations. For example, the stroke lengths in the "X" direction (aligned with the passes) cannot readily be varied, nor can the gauge points be adjusted for each pass or from pass to pass, nor can the start or gauge points readily be adjusted on the fly, or while the machine is in operation.

If an automatic feed for a roll forging machine can provide for setting up and adjusting differential pick-up or gauging positions from pass to pass, much more complex parts can be roll forged with precision and at lower cost. For example, tapered parts considerably longer than the peripheral die length can be rolled on smaller diameter or half round dies. Smaller forging rolls and dies are considerably less costly. Also, accurate gauge point correction greatly reduces roll die development and adjustment time which reduces cost. With a mechanical system this is essentially impossible because the stock has to be moving at essentially the speed of the dies at the gauging position.

Also, after the stock has been engaged it is desirable that the feed or stock gripper move into a freewheeling mode so that the stock is moved by the dies until released by the forging dies. However, during such mode it is desirable to exert a small compression or tension bias on the stock depending on the type of stock. For example for short parts a slight compression or drag is desirable while for long slender parts, a slight tension may be desirable to prevent buckling. Moreover the desired bias may change as the dies wear. This cannot be accomplished with a mechanical feed which is itself of course subject to wear.

In some roll forging operations it is preferred that the initial or heaviest pass be in the middle of the roll with subsequent passes on each side of the initial pass. This for example provides for greater flexibility of die design and extended life of roll shaft bearings. This cannot be accomplished with an automatic feed if that feed is limited to sequential traversing in the "Y" direction or transverse the passes. Thus non-sequential traversing which can readily be changed is highly desirable.

It is of course important that movement of the stock or throughput of the machine be entirely automatic so that the stock is fed to and discharged from the machine without operator assistance. It is also important that the stock be at a correct forging temperature before moving through the machine lest damage to the machine or a scrap preform or finished roll part result. A preform is a roll forged part which is subject to subsequent forging on other types of equipment.

It is also important that the machine including the feed occupy as little floor space as possible, that the feed can be retrofitted readily on existing forging machines, and that the machine be readily serviced.

SUMMARY OF THE INVENTION

A roll forging machine includes an automatic stock feed which receives the stock in a receptacle from a conveyor and then swings the stock to a horizontal feed position after sensing the temperature of the stock. If the stock temperature is insufficient for proper forging the receptacle swings to a dump position to return the stock to a furnace. If the stock temperature is sufficient the receptacle in the horizontal position is indexed into the forging rolls and to place the stock into a transfer stock gripper. When the gripper of the transfer closes the receptacle is retracted and returned to the stock receiving position. The stock gripper is mounted on a grip side for movement in the "X" direction aligned with the direction of the roll passes. The grip slide is in turn mounted on a carriage for movement in the "Y" direction transverse the direction of the roll passes. Both the grip slide and the carriage are driven electrically by respective servomotors in turn driving timing belts to which the carriage and grip slide are clamped. The servomotor for the grip slid accelerates the stock to a determined velocity until the stock is engaged by the forging rolls and then enters a freewheeling mode during roll forging during which the grip slide is driven by the forging rolls. When the roll dies disengage the stock, the grip slide decelerates the stock. During the freewheeling mode the servomotor for the grip slide may exert a slight tension or compression bias on the stock. The carriage moves the grip slide from pass to pass and may do so in any order. During the movement from pass to pass the gripper and thus the stock is rotated 90°. At the completion of the roll forging the grip slide accelerates the stock to an exit velocity whereupon the stock is released by the gripper to exit the machine. The grip slide returns the open gripper to receive the next stock to repeat the roll forging cycle.

With the present invention roll forging may be employed in shaping parts and materials heretofore not considered capable of being roll forged. Moreover, the accuracy and efficiency of the roll forging machine of the present invention greatly expands the utilization of the roll forging process.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

BRIEF DESCRIPTION OF THE DRAWINGS

In the annexed drawings:

FIG. 11 is a partially broken away somewhat enlarged elevation showing the back-to-back piston-cylinder assemblies for rotating the receptacle;

FIG. 12 is a fragmentary vertical section through the pivot for the receptacle and also illustrating the optical pyrometer for sensing the temperature of the stock within the receptacle;

FIG. 13 is an axial section through the receptacle as seen from the line 13—13 of FIG. 10;

FIG. 14 is a schematic illustration of the carriage and grip slide on one side of the roll dies with the infeed assembly on the other side, with the receptacle shown in stock receiving position;

FIG. 15 is a schematic illustration of the infeed assembly with the receptacle in the load position;

FIG. 16 is a similar illustration with the receptacle in the dump position;

DETAILED DESCRIPTION OF THE PREFERRED EMBODIMENTS

Figure 1:
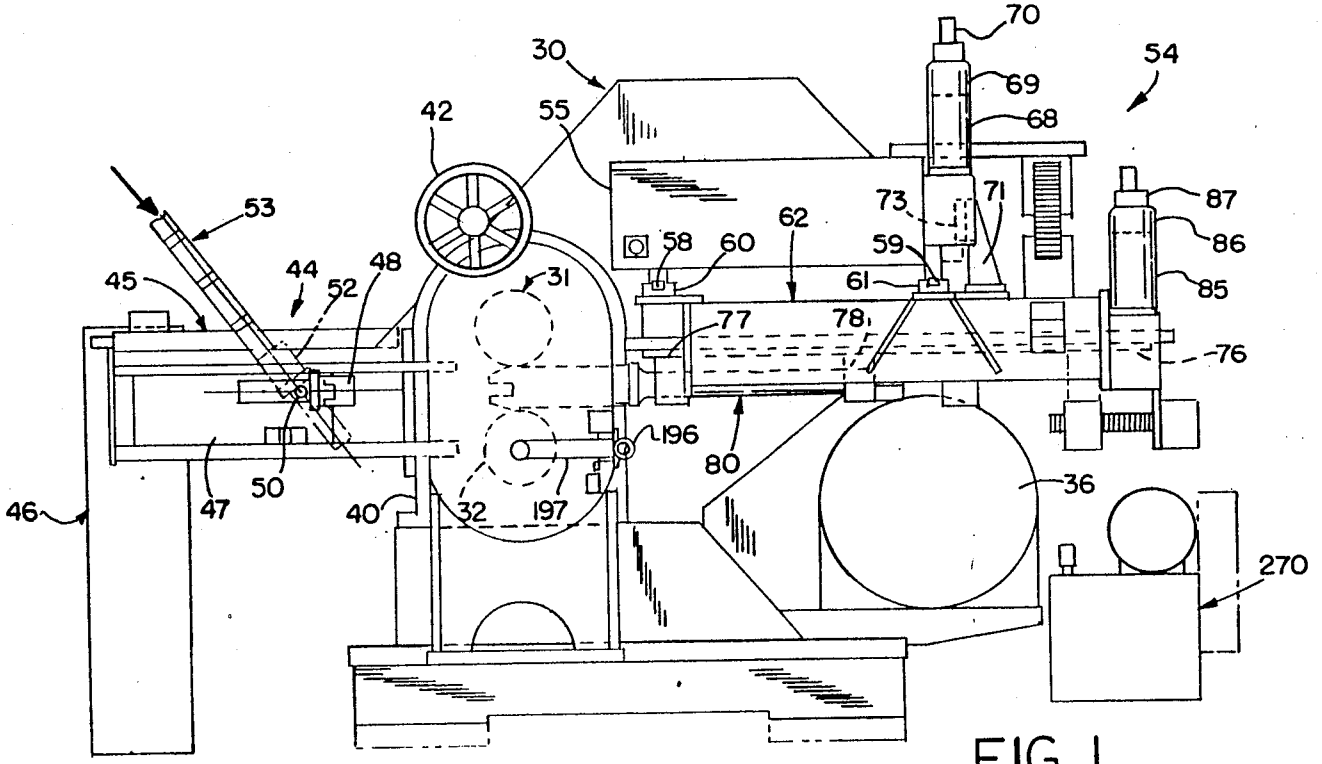
FIG. 1 is a side elevation of a roll forging machine in accordance with the present invention.
Figure 2:
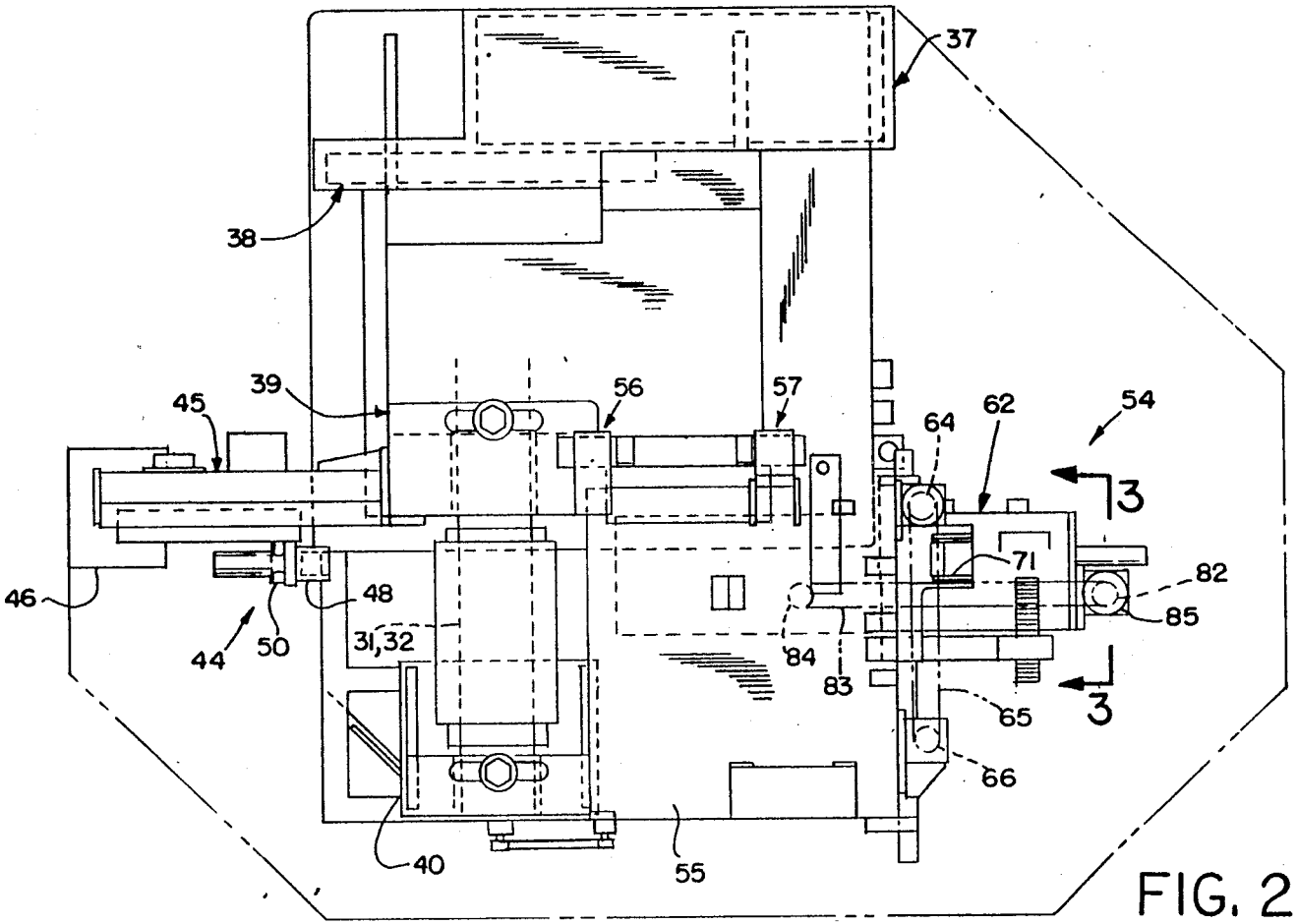
FIG. 2 is a top plan view of the machine.

Referring first to FIGS. 1, 2 and 14 there is illustrated a roll forging machine shown generally at 30 which includes parallel top and bottom roll shafts 31 and 32 on which mounted opposed rolling dies seen at 33 and 34 schematically in FIG. 14. The rolling dies are in the form of sectors or segments which are in juxtaposition with each other. The bottom roll shaft 32 rotates in a clockwise direction as seen in FIGS. 1 and 14 while the top shaft 31 rotates in a counterclockwise or opposite direction. The roll shafts are driven for such rotation by motor 36 through a flywheel in housing 37 and through a reducer 38. A clutch and brake assembly may also be employed in conventional fashion. The roll shafts extend from an inboard housing 39 to an outboard housing 40. The upper roll shaft may be vertically adjusted manually through the adjustment wheel 42.

Mounted at the front of the machine is an infeed assembly shown generally at 44. The infeed assembly is mounted on a frame 45 which extends from the inboard roll housing 39 and which may be supported on a stanchion 46 at its outer end. The infeed assembly frame supports an infeed slide 47 for horizontal reciprocation and mounted on the slide is a stock receptacle shown generally at 48. The stock receptacle 48 in the horizontal position illustrated is on the pass line at pass number one between the top and bottom roll shafts 31 and 32.

The receptacle 48 is mounted on the infeed slide on pivot 50 and may pivot to a receive position seen at 52 in which it is aligned with the discharge end of stock feed conveyor 53.

On the opposite side of the roll shafts 31 and 32 the machine is a transfer shown generally at 54 which includes a horizontally extending cantilever frame 55 which is secured to the frame of the machine as indicated at 56 and 57 in FIG. 2. On the underside of the frame there are provided two parallel rails seen at 58 and 5 on which are mounted ball bushings 60 and 61, respectively, which are mounted on top of carriage 62.

Mounted on the rear of the frame 55 is a drive sprocket 64 for timing belt 65, the timing belt also being trained about idler sprocket 66. The idler sprocket is adjustably mounted on the rear of the frame to control the tension of the belt. The timing belt 65 is driven in either direction by a servomotor 68 which includes a tachometer 69 and an encoder 70.

Figure 8:
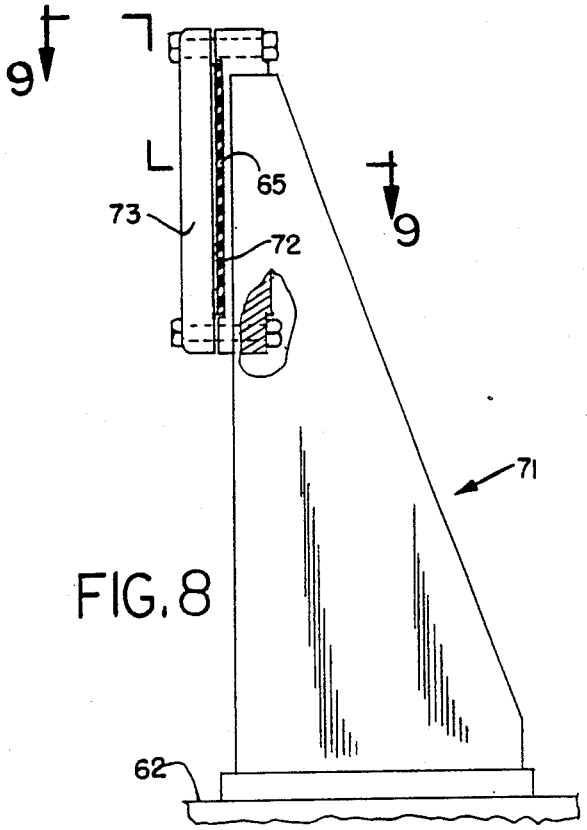
FIG. 8 is a side elevation of the bracket mounted on the carriage and clamped to the timing belt driving the carriage.
Figure 9:
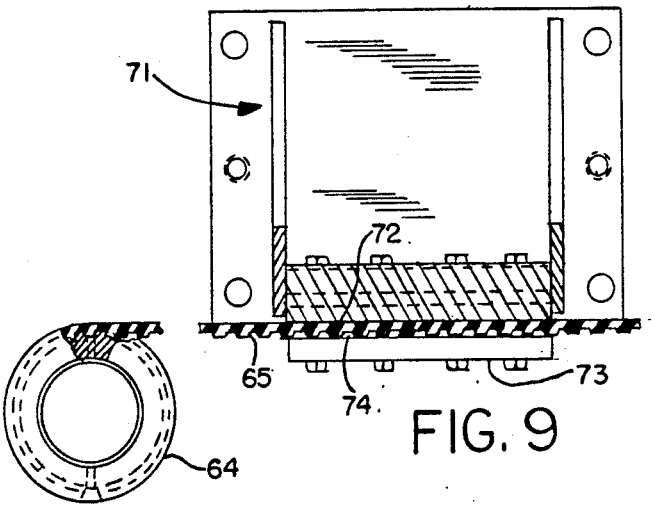
FIG. 9 is a broken horizontal section taken from the line 9—9 of FIG. 8 illustrating the carriage timing belt clamp and the timing belt drive sprocket.

As also seen in FIGS. 8 and 9, firmly secured to the top of the carriage 62 is an upstanding bracket 71 to the upper end of which belt 65 is clamped in shallow channel 72 by clamp plate 73. The clamp plate is secured top and bottom to the bracket by the fasteners illustrated and is provided with vertically extending teeth or ribs 74 which mesh with the cogs on the interior of the timing belt in the same manner as the teeth on the drive and idler sprockets. The servomotor 68 and timing belt 65 thus drive the carriage in a Y direction which is parallel to the axis of the roll shafts 31 and 32.

Figure 3:
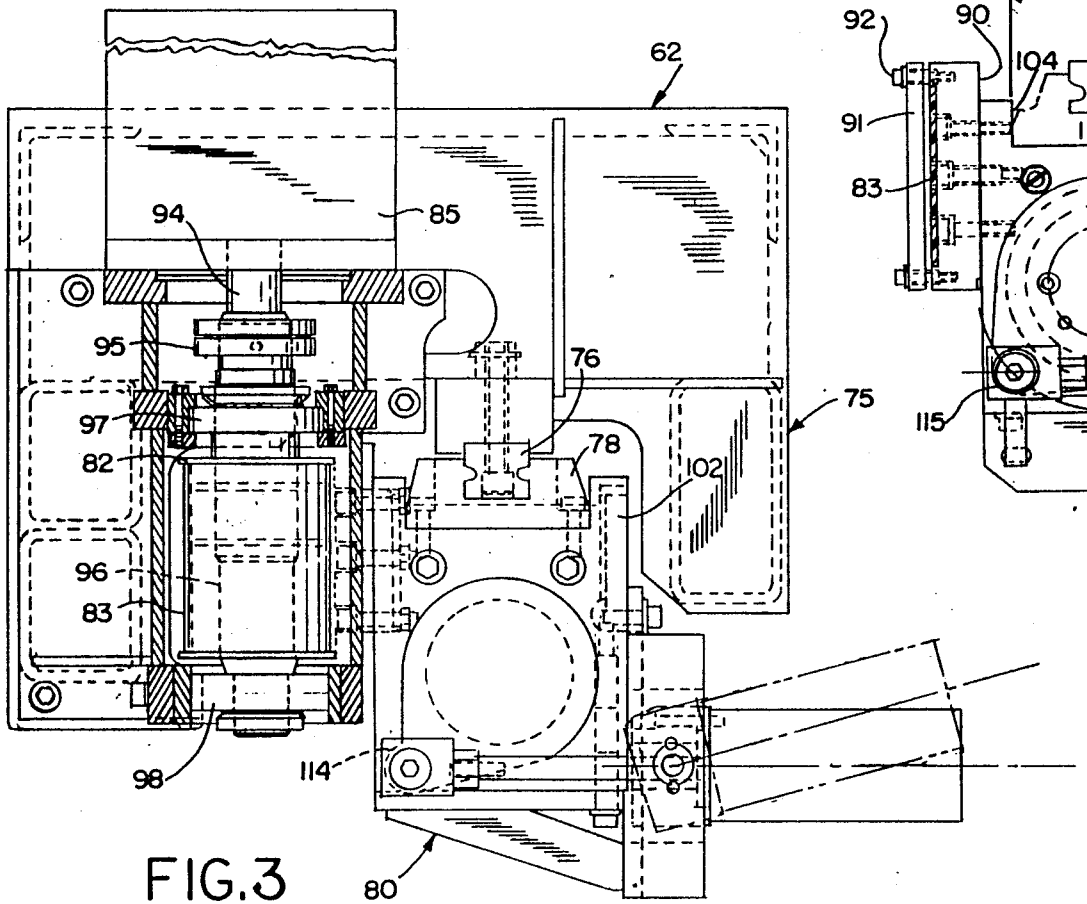
FIG. 3 is an enlarged vertical section through the end of the carriage and showing the grip slide as seen substantially from the line 3—3 of FIG. 2.

Referring now additionally to FIG. 3 it will be seen that carriage 62 includes a somewhat inverted U-shaped frame 75 to the underside of which is secured a rail 76 on which is mounted ball bushings 77 and 78 secured to the top of grip slide shown generally at 80.

Mounted at the rear of the carriage 62 is a drive sprocket 82 for timing belt 83 which is also trained about idler sprocket 84 adjustably mounted on the carriage. The drive sprocket is driven by servomotor 85 which also includes a tachometer 86 and encoder 87.

Figure 4:
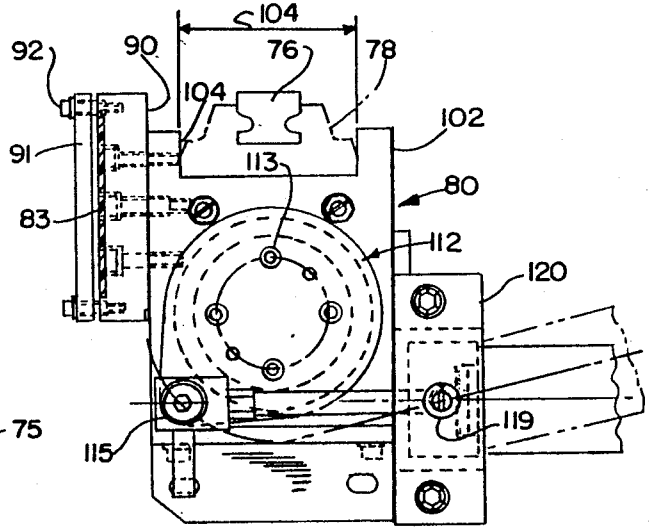
FIG. 4 is an end elevation of the grip slide illustrating more clearly the timing belt clamp and the grip rotator.
Figure 6:
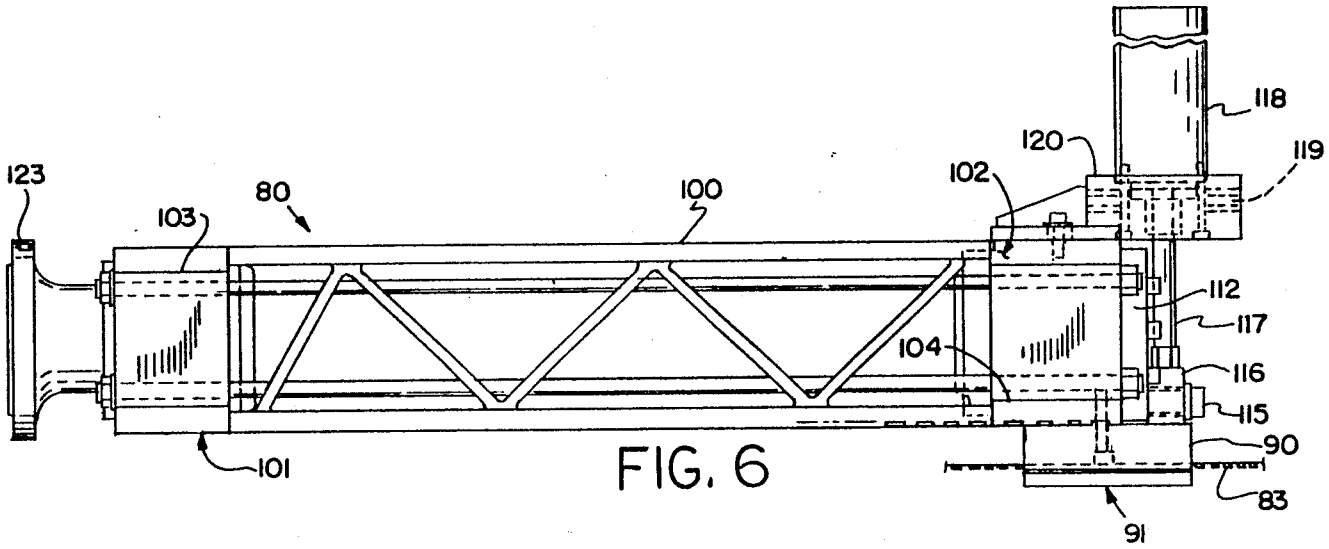
FIG. 6 is a top plan view of the rotator tube support.
Figure 5:
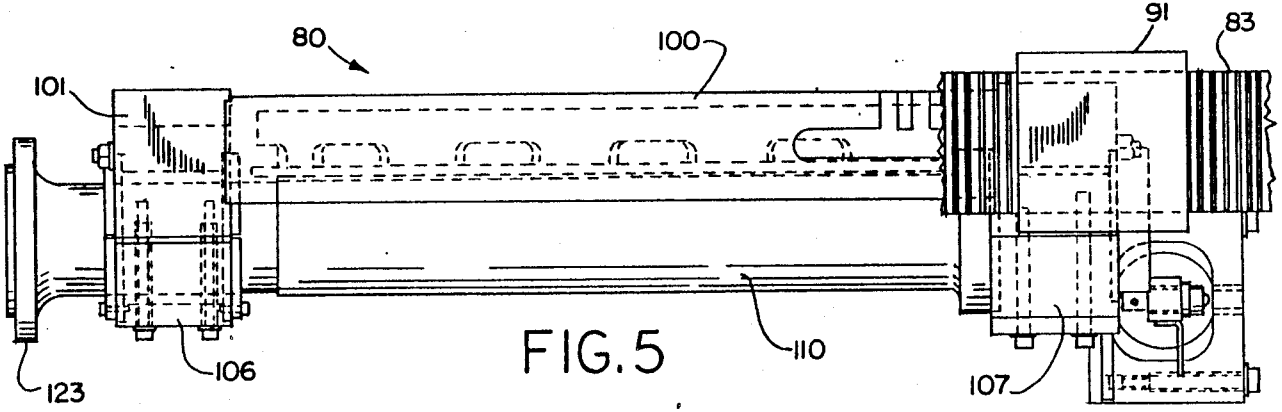
FIG. 5 is a side elevation of the rotator tube support of the grip slide with the timing belt drive broken away.

As indicated more clearly in FIGS. 4, 5 and 6, the grip slide at its rear end includes a laterally projecting block 90 which includes a relatively shallow horizontally extending channel 91 adapted to receive the timing belt 83. The timing belt is clamped to the face of the block 90 by clamp plate 91 secured in clamping position by top and bottom fasteners indicated at 92. The interior face of the clamping plate is provided with vertically extending teeth or ribs which mesh with the cogs on the interior of the timing belt firmly clamping the timing belt to the block 90.

As seen in FIG. 3 the shaft 94 of the servomotor 85 is coupled at 95 to the shaft 96 of the drive sprocket 82 for the timing belt 83, such sprocket shaft being journaled top and bottom as indicated at 97 and 98 in the frame 75. In this manner the grip slide 80 is mounted for reciprocating movement on the carriage in an X direction which is normal to a plane passing vertically through the axes of the roll shafts 31 and 32.

The use of large timing belts to which the grip slide and carriage are clamped, each driven by servomotors, provides rapid and precise controllable movement for the massive grip head and stock and yet provides an inherent shock absorbing capability.

As seen in FIGS. 5 and 6 the grip slide 80 includes an elongated frame 100 which extends between and spaces blocks 101 and 102. The tops of such blocks are provided with relatively shallow channels indicated at 103 and 104 respectively within which are secured the ball bushings 77 and 78. The belt clamp block 90 is secured to the side of the block 102 as indicated in FIGS. 4 and 6.

Each block forms the top of a pillow block bearing with the bottom of such bearings being formed by bearing blocks 106 and 107. In such bearing blocks at each of the frame 100 there is journaled a rotator tube 110. At the rear of the block 102 a cap 112 is secured to the rotator tube by fasteners 113, such cap including an eccentric projection 114 from which projects pin 115. Connected to the pin as indicated at 116 is rod 117 of piston-cylinder assembly 118. The cylinder of such assembly is pivoted on trunnion mounting 119 on bracket 120 extending from the block 102. Extension and retraction of the piston-cylinder assembly 118 will rotate the rotator tube 110 90° about its longitudinal axis.

Figure 7:
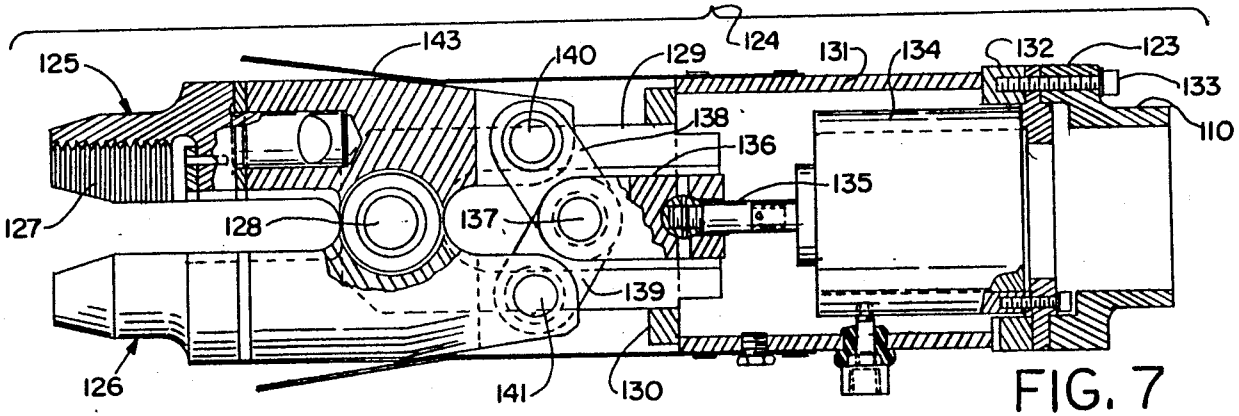
FIG. 7 is an elevation partially broken away and in section of the grip head assembly which is mounted on the end of the rotator tube.

Referring now additionally to FIG. 7 it will be seen that the front end of the rotator tube 110 includes a flange 123 to which is secured stock grip head shown generally at 124. The grip head includes two gripping fingers 125 and 126 which include serrated interior gripping surfaces 127. The fingers are both pivoted on a transverse shaft 128 which is supported by a yoke 129 extending from the wall 130 of housing 131. The rear end of the housing indicated at 132 is secured to the flange 123 by fasteners 133. Situated in the housing 131 is a piston-cylinder assembly 134, the rod 135 of which is connected to clevis 136 supporting pin 137. Toggle links 138 and 139 extend from the pin 137 to pins 140 and 141, respectively, pivoted to the rear of the fingers 125 and 126. Thus extension of the piston-cylinder assembly 134 will cause the fingers to close on the stock. Retraction of the piston-cylinder assembly 134 will cause the fingers to open or release the stock. A flexible covering or shield 143 surrounds the finger and the toggle linkage assembly protecting the same from dirt.

It can now be seen that the grip slide 80 which moves on the carriage in the X direction functions to grip and release the stock and also to rotate the stock 90°.

Referring now to FIGS. 10–13 it will be seen that the infeed assembly 44 includes the infeed slide 47 which includes a front vertical plate 147 and a rear vertical plate 148. The slide at the bottom includes not quite completely circular bushings 150 and 151 which surround rod rail 152 which is supported on bar 153 from the projection 154 of frame 45. At the top the infeed slide includes an upwardly projecting bar rail 156 captured by gibs 157 extending from projection 158 of the frame 45.

Figure 10:
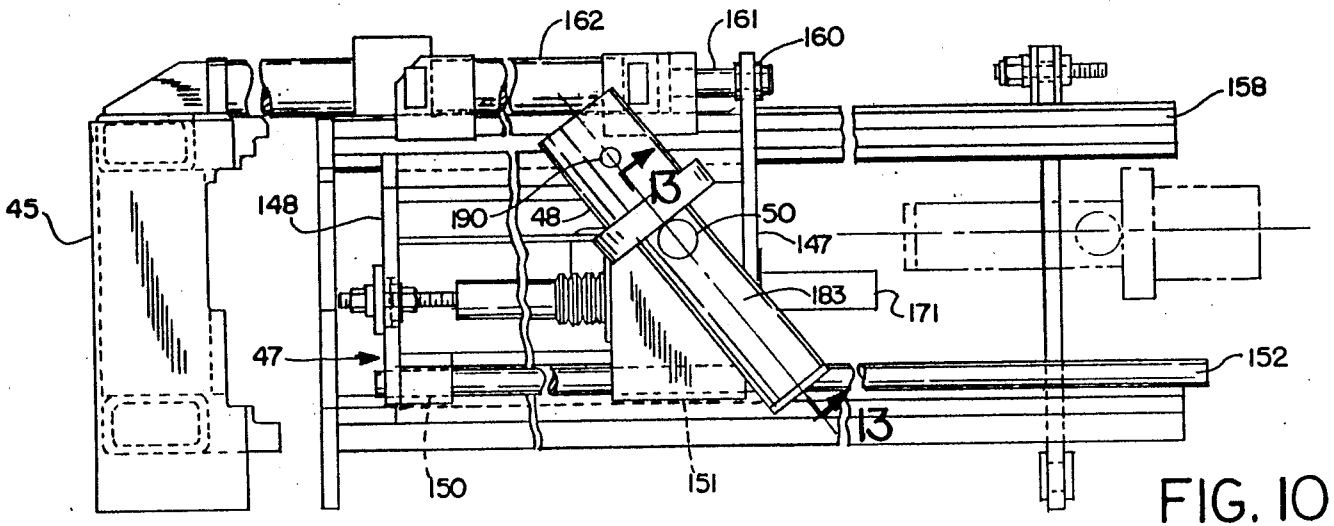
FIG. 10 is a side elevation partially broken away of the infeed assembly with the stock receptacle shown in position to receive heated stock from a conveyor.

The front plate 147 of the infeed slide extends upwardly and is offset away from the viewer in FIGS. 10 and 11 and is connected at 160 to the rod 161 of piston-cylinder assembly 162. The piston-cylinder assembly is mounted on the top of the frame 45. In this manner the infeed slide may be moved horizontally.

As seen in FIGS. 11 and 12, the front of the infeed slide 47 is provided with a housing 164 in which the pivot 50 for the receptacle 48 is journaled by the bearings seen at 165 and 166 in FIG. 12. Secured to the pivot 50 is a pinion 168 which is in mesh with rack 169. The rack 169 is supported on top of a rod 170 which extends into housing 171 on the front of the wall 147. The opposite end of the rod 170 is connected at 172 to the rod 173 of piston-cylinder assembly 174. The piston-cylinder assembly 174 has its blind end connected to the blind end of piston-cylinder assembly 175, the rod 176 of which is adjustably connected as indicated at 177 to the rear wall 148 of the infeed slide. Between the piston-cylinder assembly 174 and the housing 164 the rod 170 extends through flexible boot 178. In this manner the rack 169 is driven by back-to-back piston-cylinder assemblies 174 and 175 which have different strokes.

As seen in FIG. 13, the receptacle 48 includes an open ended cup 180 on one side of the pivot 50 from the bottom of which projects a shock absorbing plunger 181. The plunger is mounted on a rod 182 which extends through the stem 183 of the plunger into which the pivot 50 is positioned. The rod is provided with a spring seat 184 and continues through spring housing cap 185 secured to the end of the stem such housing cap forming with the recess in the end of the stem a housing for Belleville springs 186 which urge the shock absorbing plunger 181 to its extended position. The plunger may also be used to actuate a stock presence sensor which permits the receptacle to pivot.

As seen in FIG. 12, an optical pyrometer 188 is mounted on bracket 189 supported from the frame 45. In the receive position of the receptacle, the optical pyrometer is aligned with hole 190 in the side wall of the cup of the receptacle seen in FIG. 10.

The operation of the infeed assembly is perhaps best illustrated in FIGS. 14–16. Referring first to FIG. 14, with the receptacle 48 in the receive position, a stock or billet 192 slides down the infeed conveyor 53 into the receptacle 48. In such position the optical pyrometer 188 senses the temperature of the stock and if the stock is of a temperature appropriate for roll forging, the piston-cylinder assembly 174 retracts rotating the receptacle approximately 127° to the horizontal feed position shown at 193. When in such position and at an appropriate point in the cycle of the machine the piston-cylinder assembly 162 extends to move the stock 192 into position to be gripped by the fingers of the grip head 124. However, if the optical pyrometer senses that the stock temperature is inadequate for roll forging, the piston-cylinder assembly 175 also retracts to cause the receptacle to move through an additional arc of approximately 64° to the inclined downward position seen in FIG. 16 which may be termed the dump position. By this manner the stock is dumped from the receptacle to be returned to the furnace to achieve the proper temperature. Extension of both piston-cylinder assemblies 174 and 175 then returns the receptacle from either the feed position 193 or the dump position 194 to the inclined receive position seen in FIG. 14.

As seen in FIG. 1 the machine includes a resolver 196 which may be driven by timing belt 197 in a one-to-one ratio from the bottom or fixed roll shaft 32. In this manner the position of the grip head 124 can always be controlled with respect to the position of the rotating roll dies.

Figure 17:
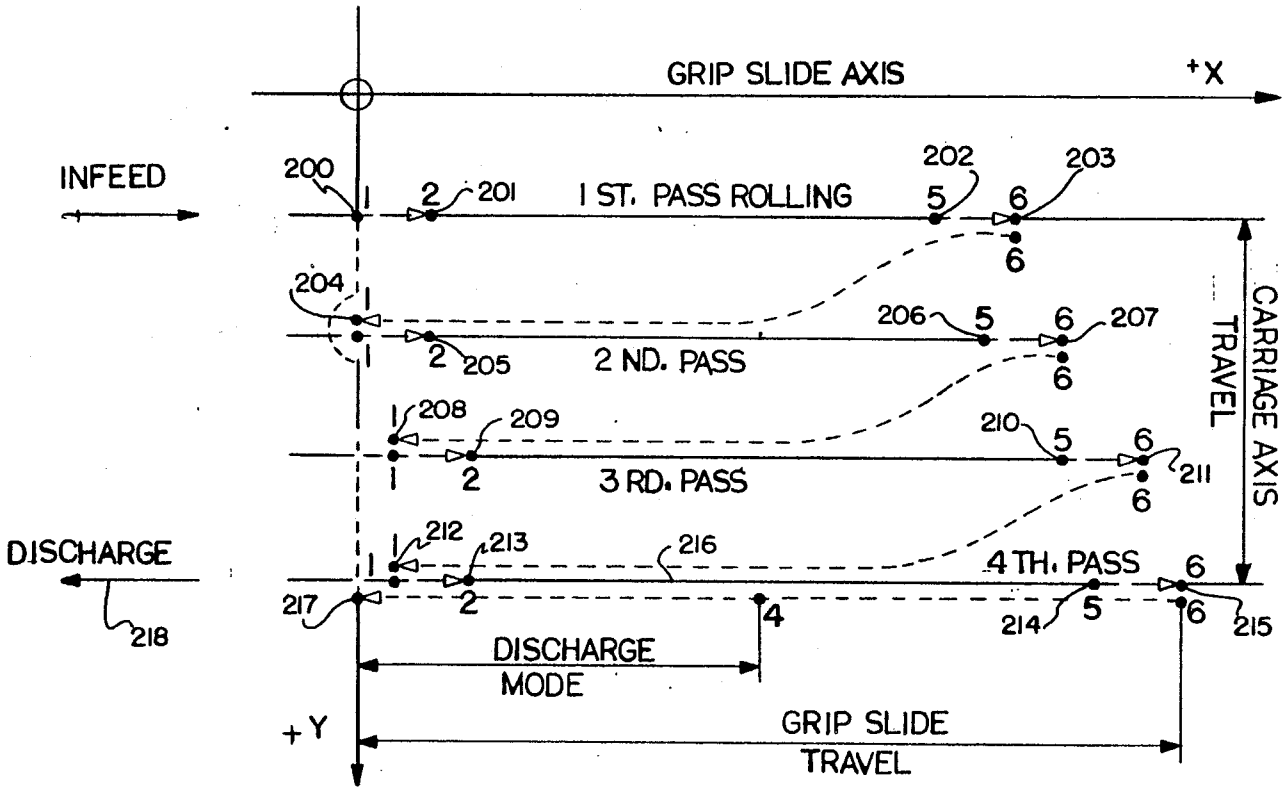
FIG. 17 is a schematic motion diagram illustrating the movement of the gripper head in a typical four pass sequence.

As seen in FIG. 17, when the receptacle in the feed position has indexed the heated stock into the grip head and the grip head has closed on the stock, the rolling cycle can commence. At the start point 200 for the first rolling pass, the servo 85 accelerates the stock to the position 201 which is the pick-up point for the first pass. At this point rolling dies engage the stock. At this point the servo motor 85 is disengaged and from the point 201 to the point 202 the movement of the grip slide is under the control of the rotating roll dies. At the point 202 the die release the stock and the servomotor 85 then controls the grip slide to bring the grip slide to a stop at the point 203. At the point 203 the servomotor 68 is energized to shift the carriage and thus the grip slide to the next pass as indicated by the dotted line 204. All of this occurs while the servomotor 85 is returning the grip slide to the point 204 at the second pass. During this movement from the point 203 to the point 204 the piston-cylinder assembly 118 may be actuated to rotate the grip head 90°.

The servomotor 85 again accelerates the grip head to the pick-up point 205 and again the roll dies move the grip slide to the point 206 where the servomotor 85 again stops the grip slide at the point 207. As the grip slide returns to the point 208 at the start of the next pass the carriage indexes the grip slide along the Y axis and again the piston-cylinder assembly 118 may be actuated to rotate the grip head 90°. At the beginning of the third pass the grip slide accelerates the grip head to the pick-up point 209 and again the roll dies move the stock and grip slide to the point 210 whereupon the servomotor 85 brings the grip slide to a halt at the point 211. Again the carriage indexes the grip slide along the Y axis as the grip slide returns to the start point 212 of the fourth and final pass with the piston-cylinder assembly 118 once again rotating the grip head about its axis 90°. At the fourth pass the servomotor 85 accelerates the grip head to the pick-up point 213 and the roll dies again move the grip head to the position 214 where the servomotor brings the grip slide to a halt at the position 215. From the position 214 the servomotor 85 accelerates the grip head to the position 216 at which the grip head opens. The servomotor 85 then brakes the grip slide to a halt at the position 217. The momentum of the stock discharges the stock through the fourth roll pass to the front of the machine as indicated by the arrow 218. The servomotor 68 then returns the grip head along Y axis to the position 200 to receive the stock from the infeed assembly for the next rolling cycle.

With reference to FIG. 17 it should be noted that the juxtaposed points 203, 204, 207, 208, 211, 212 and 215 are coincidental in the X axis and are shown slightly separated only for ease of illustration. It should also be noted that the start points and pick-up points for the successive roll passes are not the same. Moreover, the release points 202, 206, 210 and 214 are also not the same because of the elongation of the stock during the rolling operation. However, the machine can be precisely programmed to locate such positions for each pass depending upon the stock and roll die configuration. The motion diagram of FIG. 17 illustrates a fairly typical yet simplified roll forging operation for a roll forged part of preform.

Figure 18:
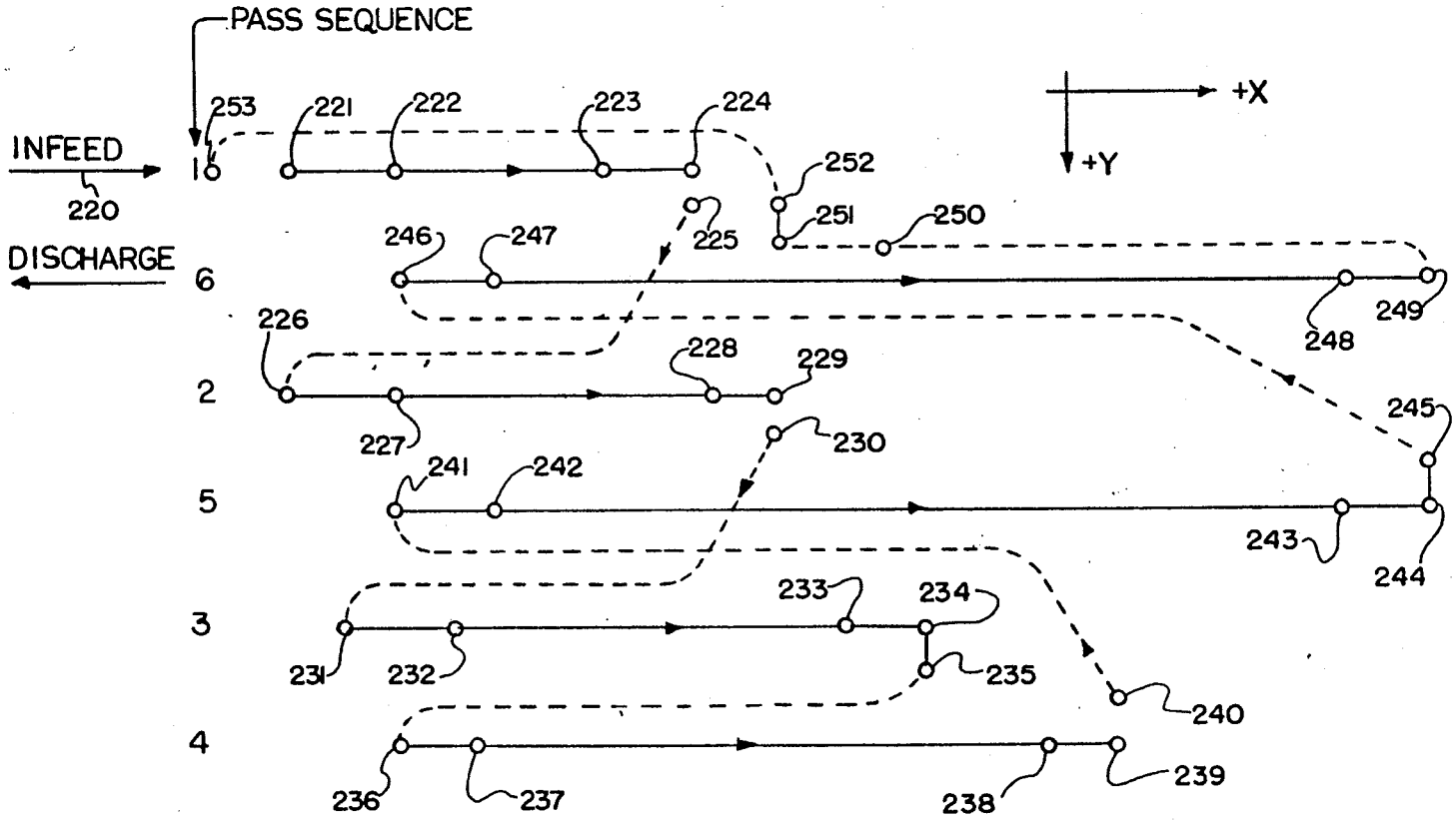
FIG. 18 is a similar motion diagram but where the infeed and first pass in the middle of the roll shafts and the passes are not linearly sequential.

For more complex roll forging operations reference may be had to FIG. 18. In such figure there is illustrated a six-pass roll forging operation and an operation in which the initial pass or pass number one is positioned substantially in the middle. Since the initial pass may deform more metal than subsequent passes, it is preferred roll forging practice to place the initial pass in the middle of the roll shafts away from the shaft bearings to avoid undue wear or damage to such bearings. As seen in FIG. 18 the stock is moved into the initial pass by the infeed assembly as indicated by the arrow 220 and is gripped by the grip head at the start position 221. The stock is then accelerated to the pick-up point at the first pass as indicated by the position 222. At the release point 223 the servomotor for the X axis starts to decelerate the grip head and at the point 224 the carriage to traverse in a positive X direction to position the grip head in line with pass number two at the top of the figure. However, the servomotor 85 does not halt the grip slide until the point 225 at which point it begins accelerating the grip slide in the opposite direction to the point 226, at which the grip slide is reversed to the pick-up point 227 at pass number two. At the release point 228 the servomotor 85 begins to decelerate the grip slide and at the point 229 the carriage now traverses in the opposite direction to bring the grip slide in line with pass number three. Servomotor 85 reverses the grip slide at 230 and at point 231 the grip slide is again reversed to bring the grip head to the pick-up point 232. At the release point 223 the grip slide is decelerated and at the point 234 the servomotor 68 is energized to move the carriage in a minus X direction with the grip slide stopping at the point 235.

Reversal of the grip slide move the grip head to the point 236 where the grip head is again reversed to accelerate to the pick-up point 237 at pass number four. At point 238 the dies release the stock in pass number four and at point 239 the carriage is again free to index in the minus X direction with the grip slides stopping at the point 240 and accelerating back to the point 241 to accelerate again to the pick-up point 242 for the fifth pass. At point 243 the dies release the stock and at the point 244 the carriage may again index the grip slide in the minus Y direction with the grip slide stopping at the point 245 to return to the point 246 reverse and accelerate again to the pick-up point 247 for the sixth and final pass. At the point 248 the dies release the stock and at the point 249 the carriage again indexes in the minus Y direction with the grip slide reversing itself at point 250 to accelerate to the discharge point 251 at which the fingers of the grip head are opened. The roll forged stock is then discharged by momentum as indicated by the arrow 252. At the point 253 the grip slide is reversed and at the point 254 the carriage is then indexed in the plus X direction with the grip slide reversing at the point 255. The grip head is then repositioned at the starting point 256 to receive the next stock from the infeed assembly as indicated by the arrow 220. Again, during the traversing of the carriage in the plus or minus X direction, the piston-cylinder assembly 118 may be actuated to cause the stock to rotate 90° on its own axis from pass to pass.

Figure 19:
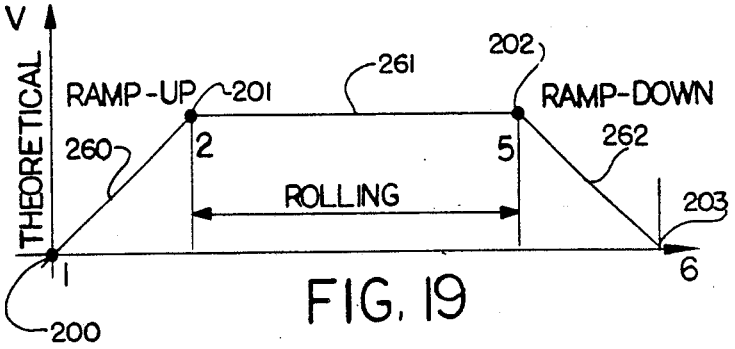
FIG. 19 is a velocity diagram for the grip slide.

Referring now to FIG. 19 there is illustrated a velocity diagram for the grip slide for a given pass. At the start point 200 the grip slide accelerates to the gauging or pick-up point 201 through a ramp up mode indicated at 260. At the gauging or pick-up point 201 the velocity remains essentially constant as indicated at 261 through a freewheeling mode wherein the grip slide is actually driven by the roll forging dies engaging the stock. At the release or disengagement position 202 the servomotor 85 serves to decelerate the grip slide through a ramp down mode 262 to the final position 203. Both the ramp up mode 260 and the ramp down mode are at constant torque and constant current. The ramp up or constant torque mode is terminated at the position 201 and the drive system is instantaneously switched into a freewheeling mode in which the stock position and velocity are controlled by die contact radius and the rpm of the roll shafts 31 and 32.

Figure 20:
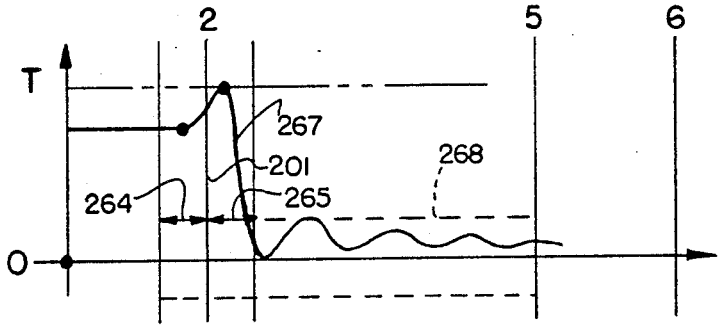
FIG. 20 is a torque diagram illustrating rolling with a slight tension bias.

However, due to stock diameter tolerance and die wear it is difficult to define exactly a gauge or pick-up position 201. Therefore, a range or preselected switching band is created on each side of the pick-up point 201 as indicated at 264 and 265 in the torque diagram of FIG. 20. Within such range the drive system will automatically switch into a free-wheeling or self compensating mode. In such self compensating mode the torque indicated by the line 267 immediately drops to be within a range from zero to an upper limited indicated by the line 268 thus providing a slight tension bias during the freewheeling or rolling mode.

Figure 21:
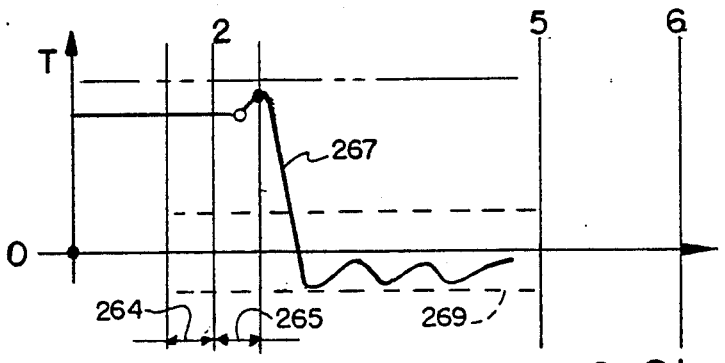
FIG. 21 is a torque diagram illustrating rolling with a slight compression bias.

As seen in FIG. 21, with a compression mode the torque 267 may drop below zero within the range provided by the line 269. In this manner a slight compression bias during the rolling mode is provided. The tension or compression bias may be selected by the operator. For short parts a slight compression bias is recommended and for long, slender rolled parts a slight tension bias would be used to prevent buckling. In any event during ramp up or ramp down the torque is constant and during the rolling mode the torque may provide a slight tension compression bias.

Because of the use of the resolver 196 and the servomotor 68 and 85 with respective tachometers and encoders, the machine of the present invention can be controlled through a suitable program and with such program adjustments on the fly can be made. In this manner the engagement or pick-up point can be brought closer or farther away for any pass. Thus in addition to being able to set differential pick-up points, such points can be individually adjusted. In this manner tapered parts considerably longer than the peripheral die length can be rolled on smaller diameter or half round dies. This is possible because all pick-up points are at the leading edge of the dies and smaller forging rolls may be considered thus reducing equipment cost. Being able to make accurate gauge point corrections also greatly reduces the roll die development and adjustment time thus drastically reducing the cost of roll die development and adjustment.

The machine also enables the die designer to choose the heaviest pass at the center of the dies providing greater die design freedom and extended life for roll shaft bearings.

It will also be appreciated that the present invention can readily be retrofitted on existing roll forging machines with the carriage and grip slide being driven in the Y and X directions respectively by the servomotors. The hydraulic cylinders for opening and closing the grip head and for rotating it about its axis may be driven from the hydraulic unit indicated at 270 in FIG. 1.

With the present invention there is provided an automated roll forging machine capable of roll forging parts not heretofore thought capable of being roll forged.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the following claims.

What is claimed is:

1. In combination a roll forging machine comprising top and bottom roll forging dies, a stock feed mechanism for said machine including a stock receptacle, means to position said receptacle to receive stock, means to shift said receptacle to a feed position, means to sense the temperature of such stock in said receptacle, and means responsive to the temperature of such stock either to index such stock into the dies of said machine for roll forging or to move the receptacle to a stock dump position.

2. The combination set forth in claim 1 wherein said receptacle is mounted for horizontal movement on a slide.

3. The combination set forth in claim 2 wherein said receptacle is mounted for pivotal movement on said slide.

4. The combination set forth in claim 3 including a rack and pinion for rotating said receptacle.

5. The combination set forth in claim 4 including back-to-back piston-cylinder assemblies for moving said rack, one of which is actuated to move such stock to a stock feed position and both to move such stock to the dump position.

6. A feed mechanism for a forging roll machine comprising a slide movable horizontally toward and away from the forging rolls of the machine, a stock receptacle mounted on said slide, and means to pivot said receptacle on a horizontal axis from a stock receiving position to a stock loading position whereby indexing of said slide when said receptacle is in said loading position will move the stock into the forging roll machine.

7. A feed mechanism as set forth in claim 6 wherein said receptacle is mounted for rotational movement on said slide.

8. A feed mechanism for a forging roll machine comprising a slide movable horizontally toward and away from the forging rolls of the machine, a stock receptacle mounted on said slide, and means to move said receptacle from a stock receiving position to a stock loading position whereby indexing of said slide when said receptacle is in said loading position will move the stock into the forging roll machine, said receptacle being mounted for rotational movement on said slide, said receptacle in said stock receiving position extending upwardly to receive such stock by gravity.

9. A feed mechanism as set forth in claim 8 including means responsive to stock positioned in said receptacle to move the receptacle to a horizontal stock loading position.

10. A feed mechanism as forth in claim 9 including means to sense the temperature of such stock in said receptacle, and means responsive to an inadequate for roll forging temperature sensed to rotate said receptacle to a downwardly extending position to dump the stock from the receptacle.

11. A feed mechanism as set forth in claim 9 including means to sense the temperature of such stock in said receptacle, and means responsive to an adequate for roll forging temperature sensed to index said slide when said receptacle is in such loading position.

12. A feed mechanism as set forth in claim 8 including a rack and pinion operative to rotate said receptacle.

13. A feed mechanism as set forth in claim 12 including back-to-back piston-cylinder assemblies operative to move said rack, one piston-cylinder assembly being actuated to move said receptacle from the stock receiving position to the stock loading position.

14. A feed mechanism as set forth in claim 13 including a stock dump position, both piston-cylinder assemblies being actuated to move said receptacle to said stock dump position.

15. A feed mechanism as set forth in claim 14 wherein said receptacle moves more than 90° from the stock receiving position to the stock loading position and less than 90° from the stock loading position to the stock dump position, said piston-cylinder assemblies being thus of unequal length.

16. A method of feeding stock to a roll forging machine comprising the steps of gravity feeding heated stock from a furnace conveyor and the like into a cupped receptacle, sensing the temperature of the stock, and then in response to the temperature of the stock placing the stock in a transfer for the roll forging machine or returning the stock to the furnace.

17. A method as set forth in claim 16 wherein the temperature of such stock is sensed in the receptacle.

18. A method of feeding stock to a forging roll machine comprising the steps of receiving heated stock from a furnace conveyor and the like, sensing the temperature of the stock, and then in response to the temperature of the stock placing the stock in a transfer for the forging roll machine or returning the stock to the furnace, wherein the step of receiving comprises gravity feeding the heated stock into a receptacle; the temperature of such stock being sensed in the receptacle and the receptacle being pivoted on a horizontal axis to position the stock for feeding to be then moved horizontally to place the stock in the transfer.

19. A method as set forth in claim 18 wherein the receptacle is pivoted to a downwardly inclined position to return the stock to the furnace.

* * * * *